US005442934A

United States Patent [19]

Wolflick

[11] Patent Number: 5,442,934

[45] Date of Patent: Aug. 22, 1995

[54] CHILLED GAS TRANSMISSION SYSTEM AND METHOD

[75] Inventor: John R. Wolflick, McKinney, Tex.

[73] Assignee: Atlantic Richfield Company, Los Angeles, Calif.

[21] Appl. No.: 226,918

[22] Filed: Apr. 13, 1994

[51] Int. Cl.[6] ..... F25D 9/00

[52] U.S. Cl. ..... 62/401; 62/87; 62/260; 165/45

[58] Field of Search ..... 62/87, 401, 260; 165/45

[56] References Cited

U.S. PATENT DOCUMENTS

| | | | |
|---|---|---|---|
| 3,846,994 | 11/1974 | Reid | 62/87 |
| 4,192,655 | 3/1980 | von Linde | 62/87 |
| 4,584,883 | 4/1986 | AbuJudom, III | 62/87 |

OTHER PUBLICATIONS

"Analysis of Gas Chilling Alternatives for Arctic Pipelines" by Alexander Dvoiris, et al, Pipeline Engineering, ASME 1994.

*Primary Examiner*—Ronald C. Capossela
*Attorney, Agent, or Firm*—Michael E. Martin

[57] ABSTRACT

Gas compression and chilling systems, particularly adapted for compressing and chilling gas for transmission through arctic pipelines are provided with a cross heat exchanger for transferring heat from gas compressed to the inlet gas to the compressor. The heat exchanger is disposed upstream of an expander which may comprise a mechanical expander or a throttling valve, or both, to achieve a predetermined final output pressure and temperature. An aerial heat exchanger is interposed between the compression and expansion stages upstream of the inlet gas heat exchanger. One embodiment of the system uses two stages of compression, aerial cooling and expansion to the final temperature and pressure.

5 Claims, 5 Drawing Sheets

CHILLED GAS TRANSMISSION SYSTEM AND METHOD

BACKGROUND OF THE INVENTION

Field of the Invention

The present invention pertains to systems which include compressors, heat exchangers and expanders for transmitting chilled gas (such as methane) through transmission pipelines which are buried in frozen soils or so-called permafrost.

Background

The development of natural gas fields in arctic regions, such as the North Slope gas and oil fields of the State of Alaska, requires the installation of gas chilling systems for transmitting the gas through pipelines which are buried in frozen soil or permafrost. If such pipelines are transmitting gas at temperatures above 0° C. (32° F.), the frozen ground in which the pipelines are buried will eventually thaw and the resulting settlement or heaving action could possibly cause catastrophic failure of the pipeline. Accordingly, preservation of the so-called permafrost is a major concern to pipeline installers and operators, not only with a view to protecting the environment, but also to minimize damage or failure of the pipelines. However, since compression of gas to facilitate its transportation through a pipeline system results in substantial temperature increase, usually well above the temperature of frozen soil, it is necessary to cool the gas at each compressor station after compression and before transport of the gas on through the buried portions of a pipeline.

Many of the pipelines proposed for transmission of gas in arctic regions are isolated and not easily accessible for servicing or monitoring the compression equipment and ancillary facilities. Accordingly, separate vapor compression type refrigeration equipment, for example, for chilling the gas being transmitted is expensive and increases concerns about maintenance and monitoring of operation of the system. Therefore, a preferred solution to the problem is one wherein the gas is cooled through heat transfer with ambient air and/or through expansion of the gas to a temperature which will alleviate thawing of the soil in which the pipeline is buried. A treatise entitled "Analysis of Gas Chilling Alternatives for Arctic Pipelines", by Dvoiris, McMillan and Taksa, Pipeline Engineering, 1994, American Society of Mechanical Engineers, discusses certain approaches to the above-stated problem.

The present invention provides several unique systems for compressing and chilling gas for transmission through pipelines buried in frozen soils wherein the temperature of the gas entering the buried section of the line is provided at about −2° C. (30° F.) or less.

SUMMARY OF THE INVENTION

The present invention provides systems for compressing gas, particularly natural gas or methane, and reducing the temperature of the compressed gas for transmission through pipelines buried in frozen soils.

In accordance with one important aspect of the invention, gas compression and chilling systems are provided which include a so-called "cross" type heat exchanger arranged such that gas discharged from a compressor is in heat exchange with gas flowing to the inlet of the compressor and gas discharged from the compressor and leaving the heat exchanger is subjected to an expansion process to reduce its temperature to that which will not cause thawing of frozen soil. By arranging a cross-type heat exchanger upstream of the compressor stage and upstream of the expansion stage, lower differential temperatures and higher minimum temperatures are experienced in the compression and expansion phases, total compression power requirements are minimized and smaller heat exchanger size is required.

The present invention also contemplates that the expansion phase of the system may be accomplished with a mechanical gas expander which will result in minimum net power requirements for the chilling and transmission system.

The present invention further contemplates a gas chilling and transmission system wherein a net pressure increase is accomplished across the system and the temperature of the gas leaving the system is reduced to that at which it entered the system and is below 0° C. (32° F.) to prevent thawing of frozen soil surrounding the transmission pipeline. The system may include a first compression stage driven by a prime mover, and a second compression stage driven by a mechanical expander wherein the gas is compressed in two stages, heat exchange through an aerial heat exchanger is accomplished and the gas is expanded after the second stage of compression to a pressure which is a net pressure above the inlet pressure and a temperature which is at or below the inlet temperature.

In accordance with yet another aspect of the present invention, a gas compression and chilling system is provided which includes a cross type heat exchanger, a compression stage and two stages of expansion which allow bypass of the discharge of the compression stage around the cross exchanger to a mechanical expander to control the temperature of the gas leaving the mechanical expander.

The systems and methods of the invention provide improvements in compression and chilling systems for transmitting gas through pipelines, particularly wherein the pipeline is buried in frozen soil or so-called permafrost. The systems provide improvements over those systems which require separate vapor compression refrigeration cooling of the transmission gas. For example, the systems of the invention provide for (a) minimizing capital equipment costs including costs of heat exchangers, compressors and expanders, (b) lower operating costs, and (c) easy remote control and unattended operation.

Those skilled in the art will recognize the above-described features and advantages of the present invention, together with other superior aspects thereof, upon reading the detailed description which follows in conjunction with the drawings.

DESCRIPTION OF PREFERRED EMBODIMENTS

Figure 1:
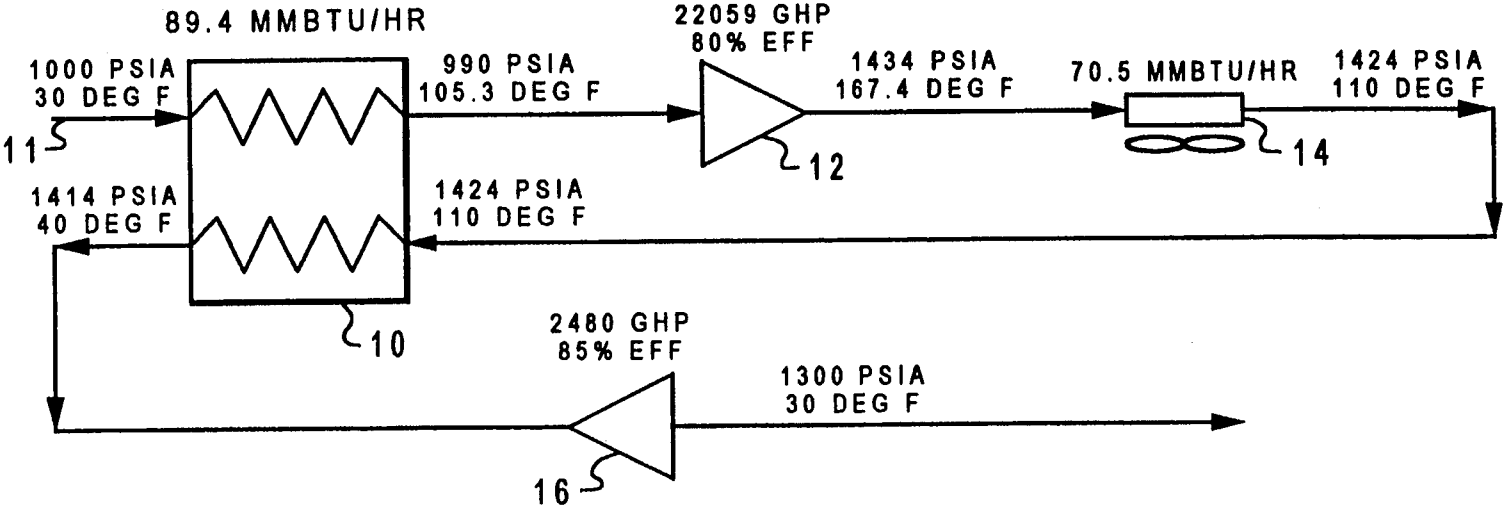
FIG. 1 is a process flow diagram of a system for a particular condition of compressing methane (natural gas) and chilling such gas to a predetermined temperature for transmission through a pipeline.

In the description which follows, like elements are marked throughout the specification and drawing with the same reference numerals, respectively. The drawing figures are intended to show the systems and methods of the invention in schematic form. Each of drawing FIGS. 1, 3, 4, 5 and 6 are examples of a gas compression and chilling system for operating on compressed methane at flow rates of one billion standard cubic feet per day at the operating conditions and efficiencies indicated in the diagrams, respectively. FIGS. 2 and 7 are schematic diagrams of a preferred mechanical arrangement of the systems illustrated in FIGS. 1 and 6, respectively.

Figure 2:
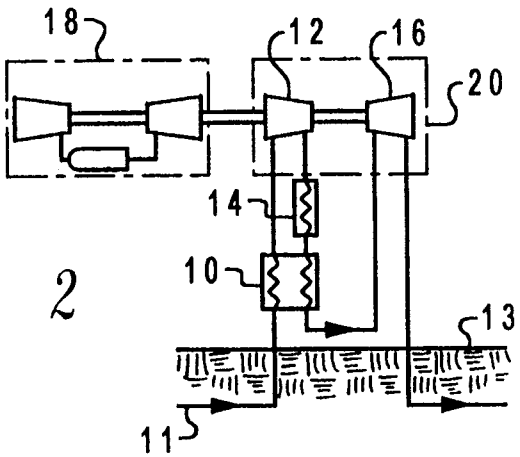
FIG. 2 is a schematic diagram showing the mechanical configuration of the system of the process diagram of FIG. 1.

Referring to FIG. 1, the diagram illustrates a heat exchanger 10, a compressor 12, a so-called aerial heat exchanger 14, providing heat exchange between the compressed gas and ambient atmospheric air (at 90° F.) and an expander 16. The inlet and outlet conditions of the gas flowing through the system at the above-mentioned rate are indicated on the figure, as well as the estimated power input requirements for the compressor 12 based on an average polytropic efficiency for centrifugal compressors, for example, and the power output of the expander 16 based on an exemplary polytropic efficiency for turbine type expanders. The heat exchangers 10 and 14 and the compressor 12 and expander 16 may be of conventional construction known to those skilled in the art of systems for compression and expansion of gases. The net input power required for operating the compressor 12 may be supplied by a suitable prime mover such as a gas turbine engine. FIG. 2 illustrates, in schematic form, one preferred arrangement of the system of FIG. 1. A prime mover comprising a combustion gas turbine 18 is drivably connected to the compressor 12 which is also drivenly connected to the expander 16. The compressor 12 and expander 16 may, in fact, be suitably constructed to be in the same "case" or enclosure 20, for example. The pipeline 11 is shown buried in frozen soil 13 except at the compression and chilling system.

The system of FIG. 1, with the exemplary operating conditions set forth in the figure, assumes that the condition of the fluid approaching the compressor station illustrated in FIGS. 1 and 2 is 1000 psia and 30° F. In gas transmission pipelines which are buried in frozen soils, it is contemplated that the gas temperature leaving a compressor station should be below 32° F. and preferably in the range of 30° F. Since certain flow losses will occur along the pipeline between compressor stations, causing a reduction in the gas pressure, a concomitant reduction in temperature will also occur as the gas approaches the next compressor station. This reduction in temperature will be effected somewhat by the temperature of the frozen soil surrounding the buried pipeline. The exemplary processes for the systems of FIGS. 1 through 4, 6 and 7 do not take this temperature drop into consideration and it is assumed that the temperature of the gas flowstream approaching the system of FIG. 1, for example, is at the desired outlet temperature of 30° F.

Moreover, the coefficient of performance, based on the Carnot refrigerator coefficient of performance relationship, is higher for the system of FIG. 1 in that the temperature at the outlet of the aerial heat exchanger 14 (the high temperature) and the temperature at the outlet of the expander 16 (the low temperature) gives a coefficient of performance which is superior to an arrangement wherein the expander would be disposed upstream of the heat exchanger 10 and compressor 12 in the gas transmission flowpath. The system of FIG. 1 includes net input power of 19,579 GHP (gas horsepower) with the power output of the expander 16 used to assist in driving the compressor 12 according to the mechanical arrangement of FIG. 2. More importantly, perhaps, is the fact that the arrangement of FIGS. 1 and 2, as compared with a system wherein expansion of the gas is carried out before the cross heat exchange is accomplished will, for the same operating conditions, require a substantially smaller heat exchanger 10 and a heat exchange rate of about thirty six percent (36%) of that required for the system described in Pipeline Engineering.

Figure 3:
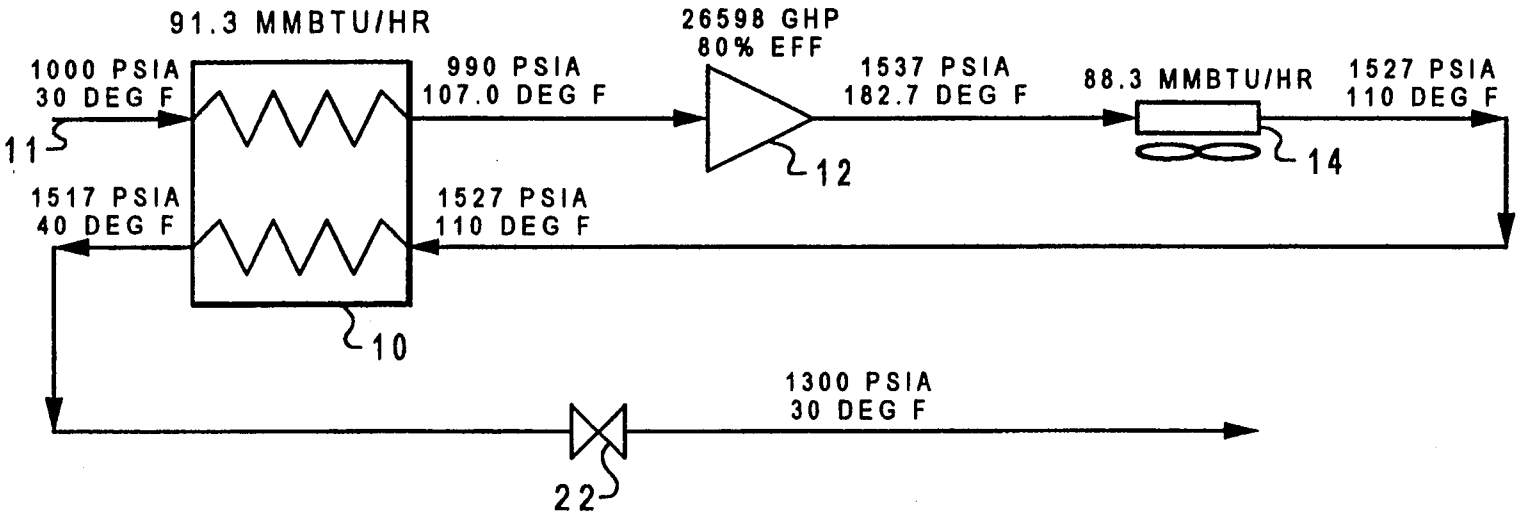
FIG. 3 is a process diagram of a system in accordance with a first alternate embodiment of the present invention.

Referring now to FIG. 3, there is illustrated a first alternate embodiment of a system in accordance with the present invention wherein the heat exchanger 10, compressor 12 and aerial heat exchanger 14 are arranged in the same manner as the system of FIGS. 1 and 2. However, the system of FIG. 3 includes a throttling valve 22 in place of the expander 16. Total power required for the system of FIG. 3 to provide the same gas outlet conditions from the throttling valve 22 is greater than the system of FIG. 1 since the expansion to the final pressure and temperature conditions prescribed using the valve 22 requires a higher output pressure from the compressor 12. A somewhat greater heat transfer load is also placed on the heat exchanger 10 and the aerial heat exchanger 14 as indicated by the operating conditions in FIG. 3.

Figure 4:
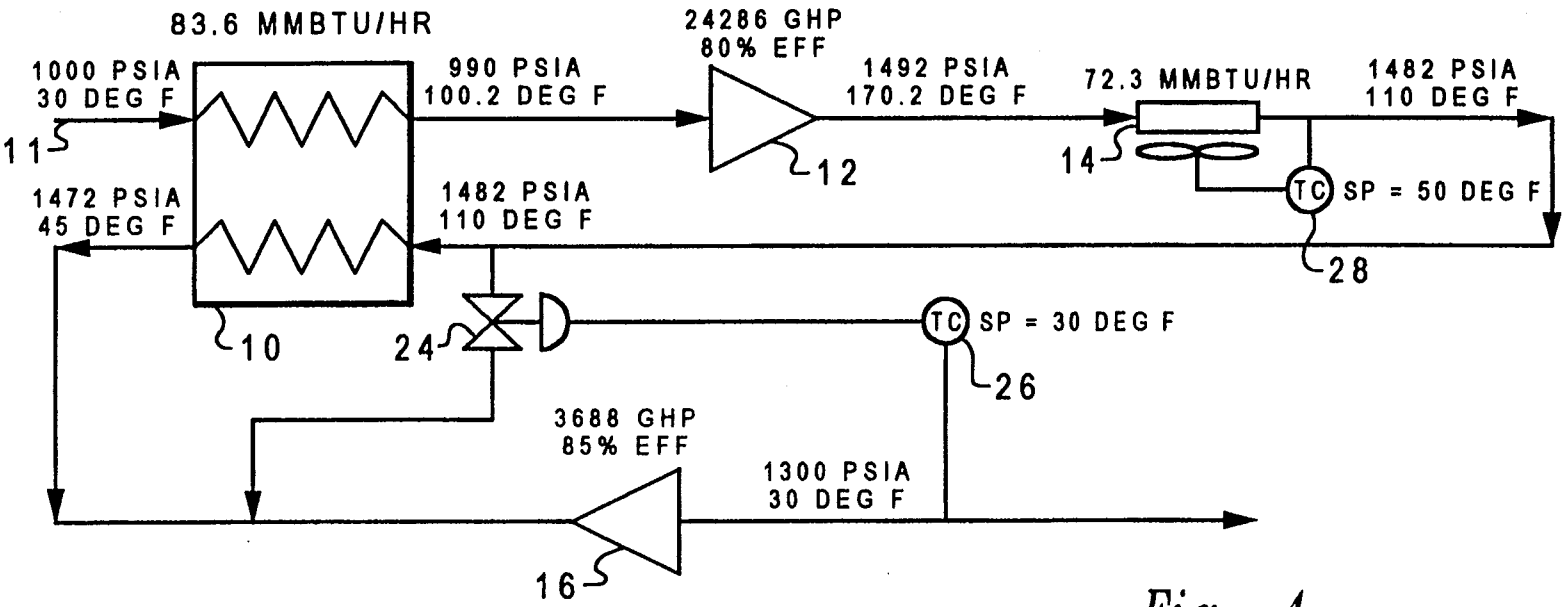
FIG. 4 is a process diagram of a system in accordance with a second alternate embodiment of the present invention.

FIG. 4 illustrates yet a further alternate embodiment of a gas chilling system in accordance with the invention wherein a heat exchanger 10 is interposed in the system in a manner similar to that for the systems of FIGS. 1 and 3. A compressor 12 and expander 16 may be mechanically connected for the system of FIG. 4 in a manner similar to that of the systems of FIGS. 1 and 2 and an aerial heat exchanger 14 is interposed between the compressor and the heat exchanger 10. The system of FIG. 4 includes a motor controlled throttling valve 24 interposed in the gas flowpath upstream of the hot gas inlet to the heat exchanger 10 for operation to allow at least some gas to bypass the heat exchanger in the gas flowpath between the aerial heat exchanger 14 and the expander 16. The throttling valve 24 is controlled by a suitable temperature controller 26 so that a set point of 30° F., for example, is accomplished for the gas leaving the expander 16 as indicated in the diagram. The system of FIG. 4 also includes a temperature controller 28 for controlling the operation of the aerial heat exchanger 14. The aerial heat exchanger 14 outlet temperature is controlled to a minimum value, shown as 50° F. which allows the heat exchanger bypass arrangement to remain in control during colder ambient temperatures to provide the gas outlet temperature from the expander 16 to remain at 30° F.

The arrangement of FIG. 4 also indicates that the heat exchanger 10 warm end temperature approach is 10° F., as compared with a 5° F. temperature approach for the system of FIG. 1, and the cold end temperature approach is increased from 10° F. (for the system of FIGS. 1 and 2) to 15° F. This change in temperature approach parameters reduces the heat transfer area requirement for the heat exchanger 10 by approximately forty percent (40%) but increases total compression power by about five percent (5%). Net power requirement for the system of FIG. 4 is 20,598 horsepower as compared with the net power requirement of the system of FIG. 1 of 19,579 horsepower.

Figure 5:
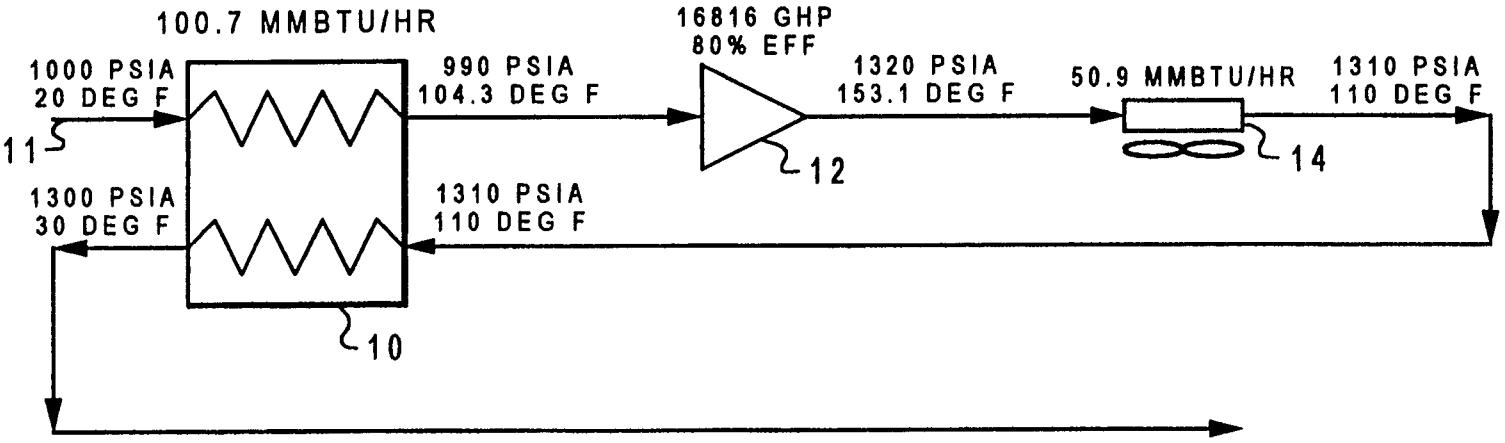
FIG. 5 is a process diagram in accordance with a third alternate embodiment of a system according to the present invention.

FIG. 5 illustrates a system similar to the system of FIG. 1, but without an expander in the gas flowpath downstream of the heat exchanger 10. The system of FIG. 5 contemplates operation wherein the gas entering the system at heat exchanger 10 is at 1000 psia and 20° F., as compared to the temperature condition of 30° F. for the systems of FIGS. 1, 3 and 4. The operating conditions for the example of FIG. 5 also contemplates a 90° F. ambient atmospheric air temperature. For these operating conditions, total compression power requirements are significantly less and the expander may be omitted.

The system of FIG. 5 could be operated in conjunction with a system such as shown in FIG. 3, that is, a throttling valve 22 could be operated during pipeline startup when there is little or no pressure drop and, accordingly, negligible temperature drop between compressor stations. As pipeline system flow and pressure ratio at the compressor station increases the valve 22 would be wide open, eventually, and the need for an expander is thus eliminated also.

Figure 6:
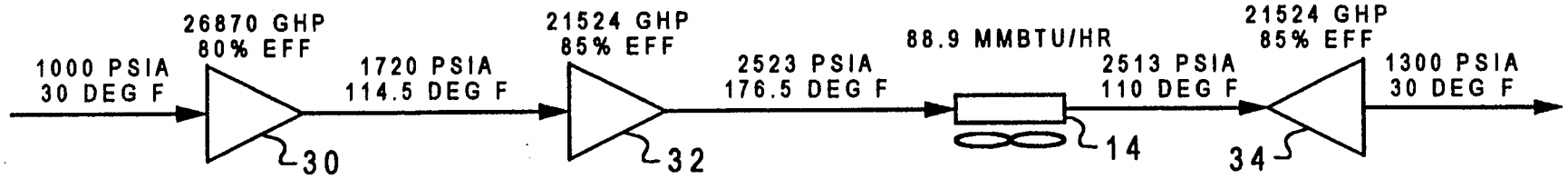
FIG. 6 is a process diagram of a fourth alternate embodiment of a system according to the invention.
Figure 7:
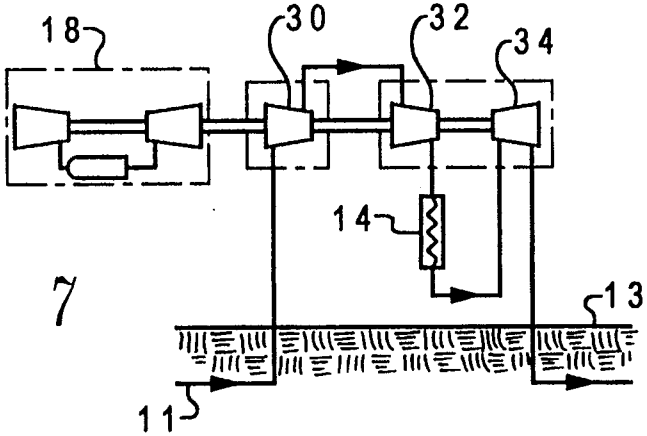
FIG. 7 is a diagram showing the mechanical configuration of the system of FIG. 6.

Referring now to FIGS. 6 and 7, there is illustrated an embodiment wherein gas chilling is carried out with two stages of compression and one stage of expansion with an aerial inter cooling step. The system illustrated in FIGS. 6 and 7 comprises a first stage of compression by a compressor 30, a second stage of compression by a compressor 32, cooling of the compressed gas by an aerial heat exchanger 14 and expansion by an expander 34. The system of FIGS. 6 and 7 omits the gas inlet cross type heat exchanger 10 used in all other embodiments of the present invention with a result that the total power requirements are approximately thirty seven percent (37%) greater than for the system of FIG. 1, for example, for the same operating conditions. The system of FIGS. 6 and 7 assumes that the net power input to the system is that to drive the compressor 30. The specific operating conditions are indicated on drawing FIG. 6. The system of FIGS. 6 and 7 contemplates an arrangement wherein a prime mover 18 comprising a gas turbine engine, for example, drives the compressor 30 and the compressor 32 is driven by the expander 34. The trade-off between the system of FIGS. 6 and 7 and the system of FIGS. 1 and 2 is, of course, elimination of the gas heat exchanger 10 for significantly higher net power requirements to achieve the same system outlet conditions of 1300 psia and 30° F. for the chilled and compressed gas.

The gas chilling systems illustrated and described hereinabove may be provided using conventional prime movers, compressors, expanders and heat exchangers commercially available or capable of being designed by those of ordinary skill in the art of gas compression and expansion systems. For the typical volumes contemplated in gas transmission systems and the pressure requirements, aerodynamic type compressors and expanders would likely be more efficient and cost effective as compared to positive displacement type compression and expansion devices.

Although preferred embodiments of a gas chilling and compression system particularly adapted for use with gas transmission pipelines buried in frozen soil have been described in some detail herein, those skilled in the art will recognize that various substitutions and modifications may be made to the systems described without departing from the scope and spirit of the invention as recited in the appended claims.

What is claimed is:

1. A gas compression and chilling system for use in compressing and chilling gas for transmission through a pipeline disposed in frozen soil, comprising:

first gas compression means;

gas expansion means;

a first heat exchanger interposed in the flowpath of gas to be compressed by said compression means and to be expanded by said expansion means such that heat is transferred from gas which has been compressed by said compression means to gas which is approaching said compression means and prior to expansion through said expansion means;

a throttling valve interposed in the gas flowpath between said compression means and said first heat exchanger for bypassing gas around said first heat exchanger to control the outlet temperature of gas flowing through said expansion means.

2. The system set forth in claim 1 including:

a second heat exchanger interposed in the gas flowpath of said system between said compression means and said first heat exchanger and operable to exchange heat between said gas and ambient atmospheric air.

3. The system set forth in claim 1 or 2 wherein:

said expansion means comprises a mechanical expander drivably connected to said compression means.

4. The system set forth in claim 1 including:

a temperature controller for operating said throttling valve to control the temperature of gas leaving said expansion means.

5. The system as set forth in claim 4, further comprising:

second compression means drivably connected to said second compression means; and wherein said first heat exchanger is interposed between said second compression means and said expansion means for reducing the temperature of gas compressed by said compression means to a predetermined value.

* * * * *